United States Patent [19]

Ruck

[11] 4,177,592

[45] Dec. 11, 1979

[54] MINIATURE ANIMATED DISPLAY

[75] Inventor: Mildred R. Ruck, Bethel Park, Pa.

[73] Assignee: Ruck Engineering, Inc., Bethel Park, Pa.

[21] Appl. No.: 845,616

[22] Filed: Oct. 26, 1977

[51] Int. Cl.[2] ..... G09F 19/00

[52] U.S. Cl. ..... 40/426; 46/139

[58] Field of Search ..... 40/426, 411, 414, 430, 40/435; 46/235, 241, 137, 139, 140

[56] References Cited

U.S. PATENT DOCUMENTS

| | | | |
|---|---|---|---|
| 2,471,002 | 5/1949 | Mohr | 40/426 |
| 2,645,880 | 7/1953 | Richter | 40/426 |
| 3,510,949 | 5/1970 | Christy | 40/426 X |
| 4,037,358 | 6/1977 | Rosenbaum | 40/426 |

*Primary Examiner*—John F. Pitrelli

*Assistant Examiner*—G. Lee Skillington

[57] ABSTRACT

A miniature animated display having figures magnetically coupled to magnets on a trapezoidal plate. A motor driven linkage moves the trapezoidal plate in a manner such that the figures appear to move randomly.

10 Claims, 6 Drawing Figures

MINIATURE ANIMATED DISPLAY

BACKGROUND OF THE INVENTION

1. Field of the Invention

The field of art implied in this invention is an animated display and application of a four bar linkage system thereto.

2. Description of the Prior Art

All animated displays per the cross references note above have heretofore embodied in the display only a single planar path, usually an oval or circle, or a slight variation thereof. In addition, the mechanisms used to move the figures on the display have been cumbersome and complicated. As is made apparent below, this invention includes multiple paths of a more complicated nature. The mechanism which drives the figures is less cumbersome and less complicated.

Examples of the prior art are U.S. Pat. No. 2,874,513 to Connell and U.S. Pat. No. 2,144,835 to Dickinson.

SUMMARY OF THE INVENTION

A miniature animated display is devised by small plastic figures moving about on a white colored opaque plastic plate. The plastic plate is attached to a molded base which houses the mechanism and the rotating power source. The small plastic figures in various postures are individually attached to small thin permanent magnetic discs. These figures are positioned on the top surface of the plastic plate and are magnetically coupled to mating drive magnets on the under side of the plastic plate. The mating drive magnets on the under side of the plastic plate are fixed at specific locations on the trapezoidal member of a four bar linkage system. The trapezoidal member and the oscillating link are driven by the input link attached to a slow revolving output shaft of a gearmotor or other rotating power source. By selecting specific locations, for the drive magnets on the trapezoidal member, the lengths for each of the links, the pivot locations on the trapezoidal member and the base of the four bar linkage system, the drive magnets and hence the figures will transcribe various routines such as circles, ovals, figure eights and oscillating motions of arc paths. Variations of these motions can be obtained by using a modified input link or by adding a translating motion to the pivot joints of the four bar linkage system.

The terms "link" and "arm", when used in this application, define equivalent structures.

BRIEF DESCRIPTION OF THE DRAWING

The accompanying drawing shows, for the purpose of exemplification without limiting the invention or the claims thereto, certain practical embodiments illustrating the principles of this invention where:

DESCRIPTION OF THE PREFERRED EMBODIMENT

The miniature animated display of this invention is a device which incorporates the translating movement of small cylindrical permanent magnets under cover of a thin opaque plastic plate. The magnets are attached to a trapezoidal non-magnetic plate at specific locations to provide a definite path of travel for each of the magnets. The trapezoidal plate is a member of a four bar linkage system that is driven through a crank link attached to a small slow turning power source. The figures, small plastic replicas of people in various poses cemented to small thin circular magnets, are positioned on the top side of the plastic plate over the cylindrical magnets located on the under side of the plastic plate. The base of the unit is a molded frame used to enclose the mechanism which drives the figures.

As the power source rotates the radial link which is a member of the four bar linkage, the trapezoidal plate, also a member of the four bar linkage, will oscillate within the confines of the radial link radius and the oscillating arm which form the third member of the four bar linkage. By selecting specific locations on the trapezoidal plate, the attached magnets will trace a definite path. The location of the four magnets chosen for this specific unit will transcribe the path of a circle, an oval, a semi-circular oscillating path, and a figure eight. The figures cemented to small circular magnets located on the top surface of the plastic plate and magnetically coupled to the cylindrical magnets on the under side of the plastic plate will in turn duplicate these various paths thus giving the appearance of figures performing various routines on the surface of the plastic plate.

Figure 6:
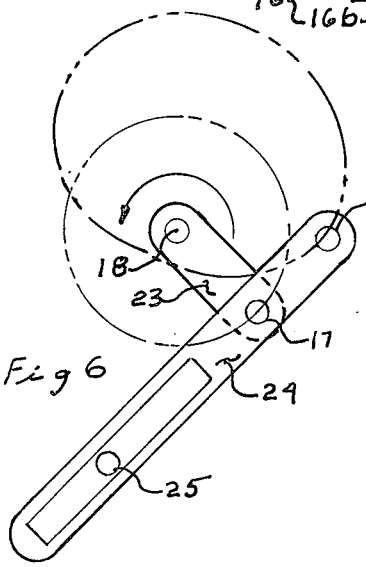
FIG. 6 describes an alternate drive system which will alter the output motions.

The device comprising this invention can be modified to give a variety of motions and any number of executions by changing the location and number of magnets on the trapezoidal plate and by changing the ratios of the lengths of the four bar links and the location of the oscillating arm pivot in the base of the unit relative to the rotating crank location. Further variations can be obtained by using a modified input link as shown in FIG. 6 or by adding a translating motion to the pivot joints of the four bar linkage system.

The entire theme or setting of the device, including but not limited to, skaters on an ice covered pond, sail boating, water skiing, ice boating, can be changed by changing the colors, appearances, figures, ratios and dimensions of the four bar linkage system, number of magnets and drive speeds individually or in combination to provide the desired effect. By proper sizing the device can be used as a unit of a miniature seasonal display assembly or as advertisement and promotional schemes.

Figure 1:
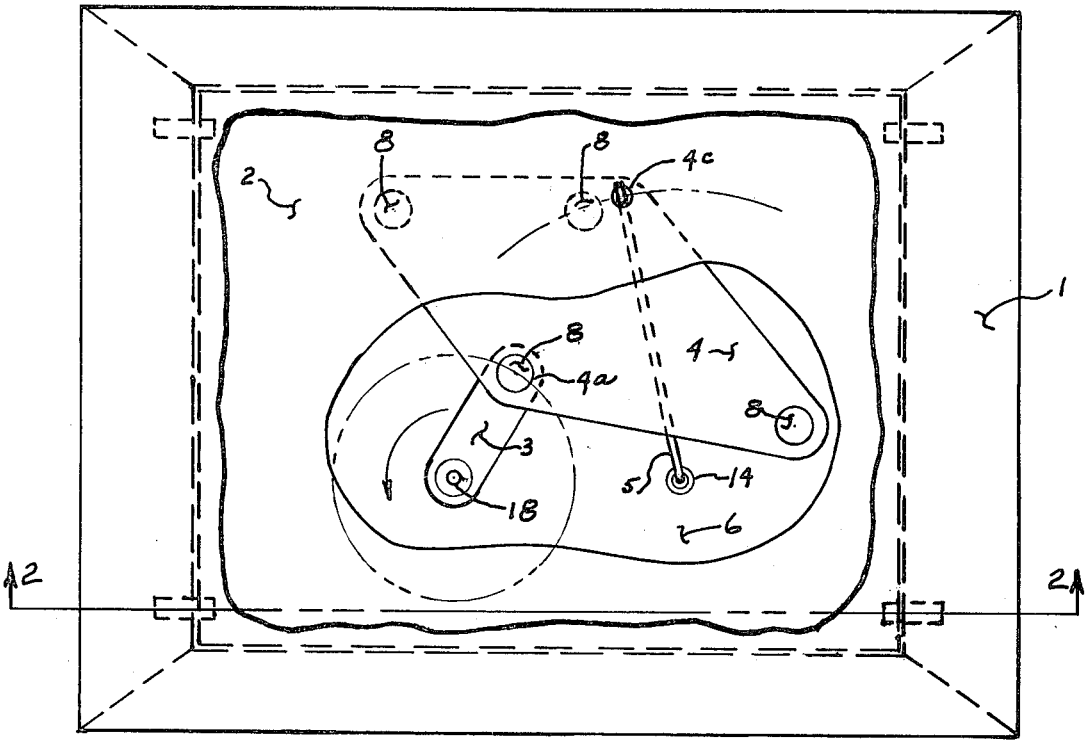
FIG. 1 is a view in plan with the figures omitted for clarity.

Referring to the drawing and particularly FIG. 1, the plan view shows the base[1] of molded construction, contoured and colored to replicate snow covered earthen banks of an ice covered pond. The base also houses the motor, the four bar linkage system and the cylindrical permanent magnets[8]. The "ice"[2] is a 1/32 inch thick sheet of white polyethylene. The radial link[3], oscillating arm[5] and trapezoidal plate[4] make up the moving parts of the four bar linkage. The bottom plate[6] approximately ⅛ inch thick non-magnetic composition board is the fourth and so called stationary link of the four bar linkage system. The bottom plate[6] also supports the drive motor[7], and provides a surface for supporting the four cylindrical permanent magnets.

Figure 2:
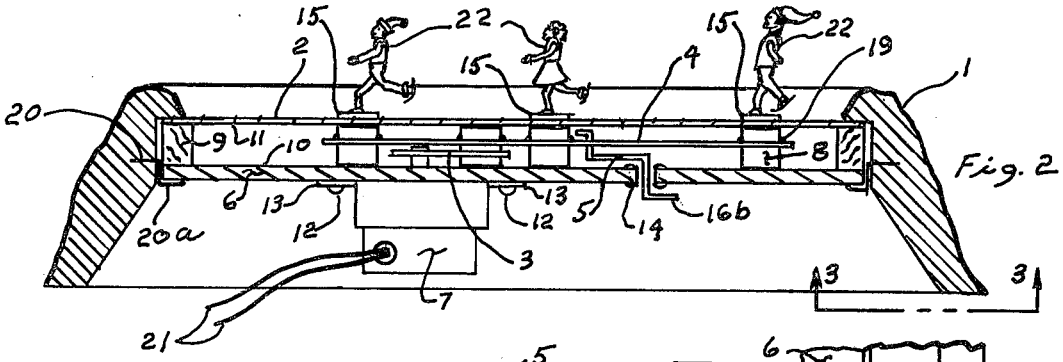
FIG. 2 is a transverse sectional view taken on the line 2—2 of FIG. 1.

FIG. 2 shows the "ice"[2] and bottom plate spaced a fixed distance apart by square cross-sectional spacers[9]. These spacers are of a definite length and are mounted and fixed to the entire periphery of the bottom plate[6]. The thickness of the spacers[9] is determined by the height of the cylindrical permanent magnets[8] plus a suitable clearance to provide free movement of the cylindrical permanent magnets[8] located between the top surface[10] of the bottom plate[6] and the underside[11] of the "ice"[2]. Appropriate holes are made in the bottom plate[6] to install and fix the motor[7] by means of tubular rivets[12] through motor mounting lugs[13]. A tubular rivet lines hole[14] is placed in the bottom plate[6] to act as a pivot point for the oscillating link[5].

Figure 4:
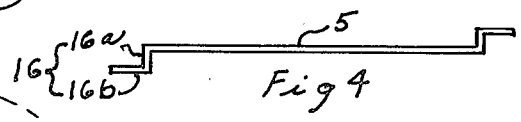
FIG. 4 is a plan view of the oscillating arm which is part of the four bar linkage.

Construction of the crank shaped ends[16] of the oscillating link[5] are shown in more detail in FIG. 4. The link[5] is made of non-magnetic material. The diameter, lengths and radius of the crank segments[16a and 16b] at each end of the link are selected in proportion to the eyelet diameter and length used in hole[14] such that the link end[16] can be threaded into the eyelet. After the oscillating link[5] is positioned parallel to the bottom plate[6] the crank segment[16b] prevents the link from disengaging the pivot hole[14]. The oscillating link[5] is engaged to the pivot hole[4c] in the trapezoidal plate[4] in the same manner. The radial link[3] is made of non-magnetic material. One end is fixed to the motor shaft[18] by any number of known methods for attaching lever arms to rotating shafts such as: friction fits, keys, set screws, pins, cementing, etc. The other end of the radial link[3] contains a hole of a diameter equal to the diameter of the cylindrical permanent magnet[8] plus clearance such that the radial link[3] will revolve freely around the cylindrical magnet[8]. The radial link[3] is positioned on the shaft of the motor at the elevation measured from the top surface[10] of the bottom plate[6] equal to ⅓ the height of the square cross-sectional spacer[9].

The trapezoidal plate[4] is made of non-magnetic material. The trapezoidal plate[4] contains five holes, four of a diameter sufficient to accept the four cylindrical magnets[8] and one hole[4c] to accept the oscillating link[5]. The four cylindrical magnets[8] are installed in the holes in the trapezoidal plate[4] and positioned such that ⅓ the length of the cylindrical magnets[8] protrudes above the trapezoidal plate[4]. The cylindrical magnets are fixed in this position by cement[19]. The trapezoidal plate[4] is assembled to the bottom plate[6] by engaging one crank end[16] of the oscillating link[5] with hole[4c] in the trapezoidal plate[4]. The other end[16] of the oscillating link[5] is engaged with the pivot hole[14] located in the base[6]. The cylindrical magnet[8] is engaged with the hole in the radial link[3] as shown in FIGS. 1 and 2. The "ice"[2] is placed on top of the spacers[9] to complete the assembly.

Figure 3:
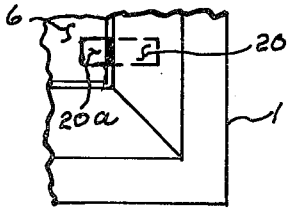
FIG. 3 is a bottom sectional view taken on the line 3—3 of FIG. 2. This view shows the location and method of securing the mechanism to the base.

Four metal strips[20] bent to form 90 degree angles are used to attach the bottom plate[6] and its associated assembly of parts to the molded base[1]. During the molding process, one leg of each of the four metal strips[20] is embodied in the four corners of the molded base[1] as shown in FIGS. 2 and 3. After the bottom plate[6] and its associated assembly of parts including the plastic plate[2] are installed in the base as shown in FIG. 2, the tab[20a] of the metal strip[20] is bent over to capture and hold the assembly in place. The motor leads[21] are attached to a suitable length of electrical conductor with plug (not shown) to complete the electrical circuit. Small thin circular magnets[15] are cemented to the skating figures[22]. Each skating figure[22] is positioned over a corresponding cylindrical magnet[8] to complete the unit and make it operational.

Figure 5:
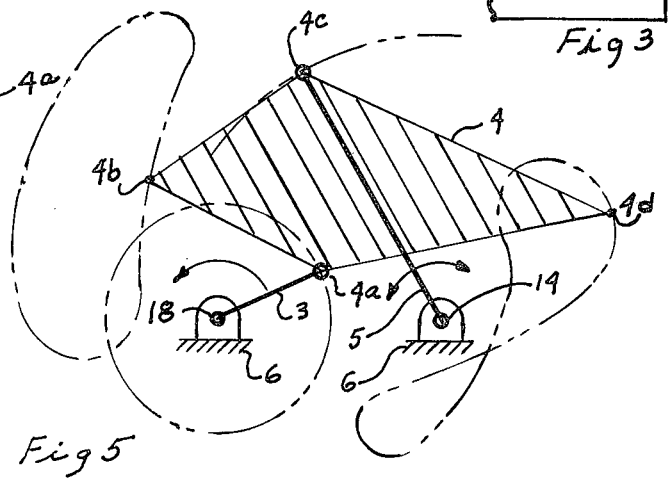
FIG. 5 is a schematic of the four bar linkage showing the motions of each link and the profile of various points on the trapezoidal member.

FIG. 5 is a schematic of the four bar linkage. The lengths of the radial link[3] and oscillating arm[5] and the distance between pivot points[14 and 18] and the locations of points[4a, 4b, 4c, and 4d] on the trapezoidal plate[4] determine the paths transcribed by points[4a, 4b, 4c and 4d] as link[3] is rotated 360 degrees. Pivot points[14 and 18] are located on the bottom plate[6], the fourth and stationary member of the four bar linkage system. Since points[4a, 4b, 4c, and 4d] also identify the location of the circular magnets[8], the magnets will also transcribe the same path configurations. To provide further variations of the output motions of points[4a, 4b, 4c and 4d] on the trapezoidal plate[4], an alternate method of driving the trapezoidal plate[4] is described in FIG. 6. Radial link[3] is replaced by a crank arm[23], one end of which is attached to the motor shaft[18]. The other end of crank arm[24] is attached to a slider bar[24] by a pivot joint[17]. One end of the slider bar[24] is slotted and is free to translate and rotate on a pin[25] fixed to the base[6]. The free end of the slider bar[24] is attached to the trapezoidal plate at pivot point[4a]. As the crank arm[23] rotates through 360° the pivot point[4a] on slider bar[24] is caused to transcribe an elliptical shape since the slotted end of the slider bar is forced to translate and pivot about the fixed pin[25]. This elliptical motion imparted to the pivot point[4a] of the trapezoidal plate[4] will cause points[4a, 4b, 4c and 4d] to transcribe variations of the motions shown in the schematic view FIG. 5.

To change the motions still further and introduce pauses in the motions of the figures[22] the pivot points[4a, 4c and 24] can be replaced with slots to allow the pivot pin in the respective pivot joints to have translation in addition to rotation.

I claim:

1. An animated display comprising;
   - a base:
   - a rigid member disposed within said base;
   - a first arm rotatably connected at one end to said rigid member;
   - a second arm, one end of said second arm rotatably connected to said rigid member and the other end of said second arm rotatably connected to said base;
   - rotating means for rotating said first arm fixed to one end of said first arm;
   - at least one plate magnet fixed to said rigid member such that at least a portion of said plate magnets extends above said rigid member;
   - a plate attached to said base above said plate magnets;
   - at least one animated figure;
   - at least one animated figure on the plate and above a plate magnet; said animated figure having a magnet attached to it such that when each of said figure magnets is placed on said plate in proximity to each of said plate magnets and said rotating means rotates said first arm, said figure magnets will become magnetically coupled to said plate magnets through said plate and said figures will be moved across said plate.

2. The animated display claimed in claim 1 wherein said rigid member is a trapezoidal plate.

3. The animated display claimed in claim 1 wherein said rotating means is an electric motor.

4. The animated display claimed in claim 1 wherein said plate is a sheet of opaque plastic.

5. The animated display claimed in claim 1 wherein said base is a molded plastic frame comprising:

a top portion bordering said plate, said top portion constructed to resemble snow covered earth surrounding a frozen pond; and a plurality of side portions extending downwardly from said top portion said side portions constructed to resemble snow covered earthen banks.

6. The animated display claimed in claim 5 wherein said animated figures resemble ice skaters.

7. An animated display comprising;

a base;

a rigid plate disposed within said base;

a first arm, one end of said first arm rotatably connected to said rigid plate and the other end of said first arm slidably connected to said base;

a second arm, one end of said second arm rotatably connected to said first arm intermediate its ends;

rotating means for rotating said second arm attached to the end of said second arm;

a third arm, one end of said third arm rotatably attached to said rigid plate and the other end of said arm rotatably attached to said base;

at least one plate permanent magnet fixed to said plate;

a sheet of nonmagnetic material attached to said base above said rigid plate and plate magnets;

at least one miniature figure;

at least one figure permanent magnet one each of said figure magnets attached to each miniature figure, each of said figure magnets being placed in close proximity to a different plate magnet whereby said plate magnets become magnetically coupled to said figure magnets and said rotating means rotates said first arm and said second arm causing said rigid plate to move within the confines of said base which causes said figure magnets and said miniature figures to move across said sheet along predetermined paths.

8. The animated display claimed in claim 7 wherein said sheet is constructed of opaque plastic.

9. The animated display claimed in claim 7 wherein said base is constructed of molded plastic.

10. The animated display claimed in claim 7 further comprising a second rotating means attached to one end of said third arm for rotating said third arm.

* * * * *